US009057976B2

(12) United States Patent
Yoshida et al.

(10) Patent No.: US 9,057,976 B2
(45) Date of Patent: Jun. 16, 2015

(54) IMAGE FORMING APPARATUS

(71) Applicant: CANON KABUSHIKI KAISHA, Tokyo (JP)

(72) Inventors: Nobuyoshi Yoshida, Suntou-gun (JP); Yoshihiro Mitsui, Numazu (JP); Kodai Hayashi, Suntou-gun (JP); Hisashi Taniguchi, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 3 days.

(21) Appl. No.: 14/061,599

(22) Filed: Oct. 23, 2013

(65) Prior Publication Data

US 2014/0119757 A1 May 1, 2014

(30) Foreign Application Priority Data

Oct. 29, 2012 (JP) ..... 2012-237795

(51) Int. Cl.
*G03G 15/06* (2006.01)
*G03G 15/08* (2006.01)

(52) U.S. Cl.
CPC ..... *G03G 15/065* (2013.01); *G03G 15/0806* (2013.01); *G03G 15/0808* (2013.01)

(58) Field of Classification Search
CPC ..... G03G 15/0806; G03G 15/065; G03G 15/0808
USPC ..... 399/55
See application file for complete search history.

(56) References Cited

U.S. PATENT DOCUMENTS

| | | | | |
|---|---|---|---|---|
| 8,190,044 | B2 * | 5/2012 | Kitamura et al. | 399/55 |
| 8,509,655 | B2 * | 8/2013 | Imanaka et al. | |
| 2010/0143003 | A1 * | 6/2010 | Saito | |
| 2010/0303486 | A1 * | 12/2010 | Shibata et al. | 399/55 |

FOREIGN PATENT DOCUMENTS

JP 2006171245 A 6/2006

* cited by examiner

*Primary Examiner* — Susan Lee
(74) *Attorney, Agent, or Firm* — Canon U.S.A., Inc. IP Division

(57) ABSTRACT

An image forming apparatus includes a control unit controlling first and second voltage application mechanisms and shifting a difference Vdif (=Vrs−Vdr) between Vrs and Vdr toward polarity opposite to normal charge polarity of a developer as S decreases, where S is an absolute value of a speed difference between a circumferential speed of an image bearing member, which rotates while bearing an electrostatic latent image and a circumferential speed of a developer bearing member, which rotates at a constant circumferential speed ratio with respect to the image bearing member to develop the electrostatic latent image while bearing the developer, Vdr is a voltage that the first voltage application mechanism applies to the developer bearing member, and Vrs is a voltage that the second voltage application mechanism applies to the developer supply member.

19 Claims, 6 Drawing Sheets

IMAGE FORMING APPARATUS

BACKGROUND OF THE INVENTION

1. Field of the Invention

The present invention relates to an image forming apparatus which forms an image on a recording material by using an electrophotographic method.

2. Description of the Related Art

An image forming apparatus using an electrophotographic image forming method (electrophotographic process), such as a printer, uniformly charges an electrophotographic photosensitive member (hereinafter, referred to as a "photosensitive member") serving as an image bearing member and selectively exposes the charged photosensitive member to form an electrostatic image on the photosensitive member. A developing device visualizes the electrostatic image formed on the photosensitive member into a toner image by using a developer (also referred to as toner). The toner image formed on the photosensitive member is transferred to a recording material such as a recording sheet and a plastic sheet. Heat and pressure are further applied to the toner image transferred to the recording material, whereby the toner image is fixed to the recording material. In such a manner, the image forming apparatus performs image recording.

The developing device includes a developer bearing member, a regulating member, and a supply member. For example, the developer bearing member is arranged in an opening of a developer container which stores the toner. The regulating member is arranged in contact with a surface of the developer bearing member, and regulates the amount of toner on the developer bearing member. The supply member rotates in contact with the developer bearing member to supply the toner to the developer bearing member.

Among examples of the developing method is a contact developing method in which the image bearing member and the developer bearing member are in contact with each other when performing development. According to such a method, high quality images can be output with less scattering of toner.

Recently, developing devices of improved image quality to which the electrophotographic process is applied have been needed to handle various media (recording materials). Such developing devices use a unit that makes output at printing speeds optimum for respective media. Suppose that the printing speed (image forming speed) is reduced without changing a circumferential speed ratio between the image bearing member and the developer bearing member. In such a case, fogging has been identified to increase in blank portions as the printing speed decreases. The fogging in blank portions refers to adhesion of toner to the blank portions. Japanese Patent Application Laid-Open No. 2006-171245 discusses that the circumferential speed ratio of the developer bearing member to the image bearing member is made higher in a mode of low printing speed than in a normal mode, whereby the fogging in blank portions is maintained at a near normal mode level.

SUMMARY OF THE INVENTION

The present invention is directed to further advancement of the foregoing conventional technique. In particular, the present invention is directed to an image forming apparatus including a developing device in which a developer bearing member and a supply member rotate in opposite directions, wherein an image forming speed can be changed while stabilizing image density and suppressing fogging.

According to an aspect of the present invention, an image forming apparatus includes an image bearing member configured to rotate while bearing an electrostatic latent image, a developer bearing member configured to rotate at a constant circumferential speed ratio with respect to the image bearing member while bearing a developer and to develop the electrostatic latent image, a developer supply member, which includes a foam layer at a surface and is arranged in contact with the developer bearing member, configured to rotate in a direction opposite to a rotation direction of the developer bearing member at a constant circumferential speed ratio with respect to the developer bearing member and to supply the developer to the developer bearing member, a first voltage application mechanism configured to apply a voltage Vdr to the developer bearing member, a second voltage application mechanism configured to apply a voltage Vrs to the developer supply member, and a control unit configured to control the first and second voltage application mechanisms, wherein the control unit is configured to shift a difference Vdif (=Vrs−Vdr) between Vrs and Vdr toward polarity opposite to normal charge polarity of the developer as S decreases, where S is an absolute value of a speed difference between a circumferential speed of the image bearing member and a circumferential speed of the developer bearing member.

According to another aspect of the present invention, an image forming apparatus includes an image bearing member configured to rotate while bearing an electrostatic latent image, a developer bearing member configured to rotate at a constant circumferential speed ratio with respect to the image bearing member while bearing a developer and to develop the electrostatic latent image, a developer supply member, which includes a foam layer at a surface and is arranged in contact with the developer bearing member, configured to rotate in a direction opposite to a rotation direction of the developer bearing member at a constant circumferential speed ratio with respect to the developer bearing member and to supply the developer to the developer bearing member, a first voltage application mechanism configured to apply a voltage Vdr to the developer bearing member, a second voltage application mechanism configured to apply a voltage Vrs to the developer supply member, and a control unit configured to control the first and second voltage application mechanisms, wherein the control unit is configured to cause a difference Vdif (=Vrs−Vdr) between Vrs and Vdr to have a value of the same polarity as normal charge polarity of the developer and to reduce Vdif in absolute value as S decreases, where S is an absolute value of a speed difference between a circumferential speed of the image bearing member and a circumferential speed of the developer bearing member.

According to yet another aspect of the present invention, an image forming apparatus includes an image bearing member configured to rotate while bearing an electrostatic latent image, a developer bearing member configured to rotate at a constant circumferential speed ratio with reference to the image bearing member while bearing a developer and to develop the electrostatic latent image, a developer supply member, which includes a foam layer at a surface and is arranged in contact with the developer bearing member, configured to rotate in a direction opposite to a rotation direction of the developer bearing member at a constant circumferential speed ratio with respect to the developer bearing member, a first voltage application mechanism configured to apply a voltage Vdr to the developer bearing member, a second voltage application mechanism configured to apply a voltage Vrs to the developer supply member, and a control unit configured to control the first and second voltage application mechanisms, wherein the control unit is configured to cause a difference Vdif (=Vrs−Vdr) between Vrs and Vdr to have a value of polarity reverse to normal charge polarity of the developer and to increase Vdif in absolute value as S decreases, where S is an absolute value of a speed difference between a circumferential speed of the image bearing member and a circumferential speed of the developer bearing member.

Further features of the present invention will become apparent from the following description of exemplary embodiments with reference to the attached drawings.

DESCRIPTION OF THE EMBODIMENTS

Various exemplary embodiments, features, and aspects of the invention will be described in detail below with reference to the drawings.

Sizes, materials, shapes, and relative arrangement of components described in the exemplary embodiments of the present invention may be modified as appropriate according to configuration and various conditions of apparatuses to which the exemplary embodiments of the present invention are applied. The scope of the present invention is not intended to be limited to the following exemplary embodiments.

An exemplary embodiment of the present invention will be described with reference to FIGS. 1 to 5.

Image Forming Apparatus

An overall configuration of an electrophotographic image forming apparatus (image forming apparatus) according to the present exemplary embodiment will initially be described.

Figure 1:
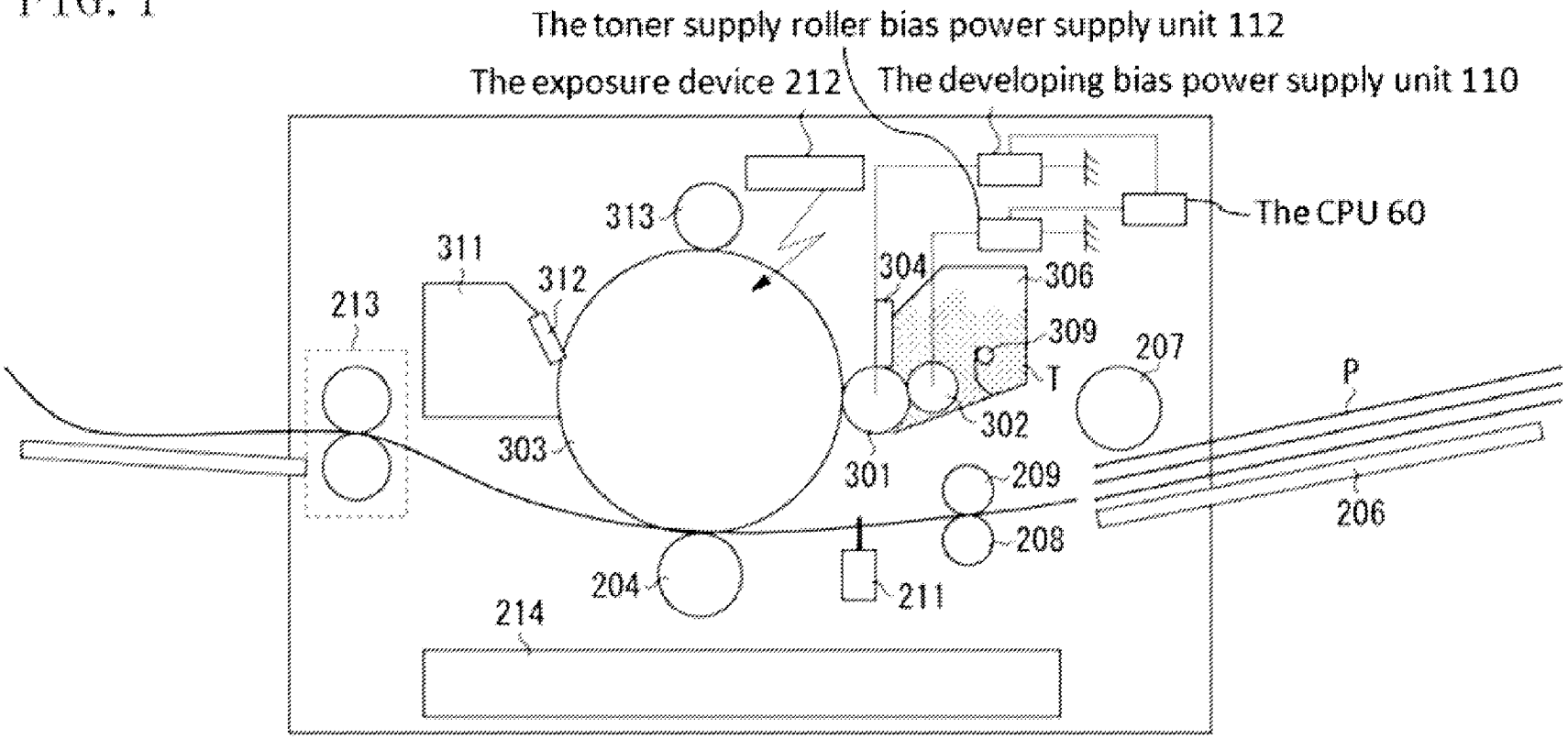
FIG. 1 is a schematic cross-sectional view illustrating a configuration of an image forming apparatus according to an exemplary embodiment of the present invention.

FIG. 1 is a schematic cross-sectional view illustrating a configuration of the image forming apparatus according to the present exemplary embodiment.

In the present exemplary embodiment, the image forming apparatus is a non-magnetic mono-component contact developing laser beam printer including a cleaning mechanism.

The image forming apparatus includes a drum-shaped electrophotographic photosensitive member (photosensitive drum) 303 serving as an image bearing member. Driving force is transmitted to the photosensitive drum 303, whereby the photosensitive drum 303 is driven to rotate about its axis in the direction of the arrow A in FIG. 2 at a predetermined process speed (circumferential speed).

A charging roller 313 serving as a charging device charges the surface of the photosensitive drum 303. The charging roller 313 is arranged in contact with the surface of the photosensitive drum 303, and driven to rotate by the rotation of the photosensitive drum 303 in the direction of the arrow A. A charging bias application power supply (not illustrated) applies a charging bias, e.g., a direct-current voltage to the charging roller 313. As a result, the surface of the photosensitive drum 303 is uniformly charged with a predetermined potential of predetermined polarity.

An exposure device 212 forms an electrostatic latent image on the charged surface of the photosensitive drum 303. The exposure device 212 includes a laser scanner, a polygonal mirror, and a reflection lens. The exposure device 212 irradiates the surface of the photosensitive drum 303 with laser beam based on image information, thereby removing charges of the irradiated portions to form an electrostatic latent image.

A developing device 306 adheres toner to the electrostatic latent image formed on the surface of the photosensitive drum 303, whereby the electrostatic latent image is developed as a toner image.

A transfer roller 204 serving as a transfer device transfers the toner image formed on the surface of the photosensitive drum 303 to a transfer material P. The transfer material P has been stored in a sheet cassette 206 and supplied to a transfer nip portion by a sheet feeding roller 207 and a registration roller 208 in synchronization with the toner image on the photosensitive drum 303. A transfer bias application power supply (not illustrated) applies a transfer bias to the transfer roller 204, whereby the toner image on the photosensitive drum 303 is transferred to the transfer material P.

After the transfer of the toner image to the transfer material P, some toner may remain on the surface of the photosensitive drum 303. A cleaning member 312 of a cleaning device 311 removes the remaining toner before the photosensitive drum 303 is subjected to the next image formation.

Meanwhile, the transfer material P with the transferred toner image is conveyed to a fixing device 213. A fixing roller and a pressure roller heat and press the transfer material P to fix the toner image on the surface.

The transfer material P with the fixed toner image is discharged from the main body of the image forming apparatus, whereby the image formation is completed.

Among the members performing an image forming process, the photosensitive drum 303, the charging roller 313, the developing device 306, and the cleaning device 311 are integrally configured as a process cartridge. The process cartridge is configured to be detachably attached to the main body of the image forming apparatus.

Process Cartridge

Next, an overall configuration of the process cartridge mounted on the image forming apparatus of the present exemplary embodiment will be described.

Figure 2:
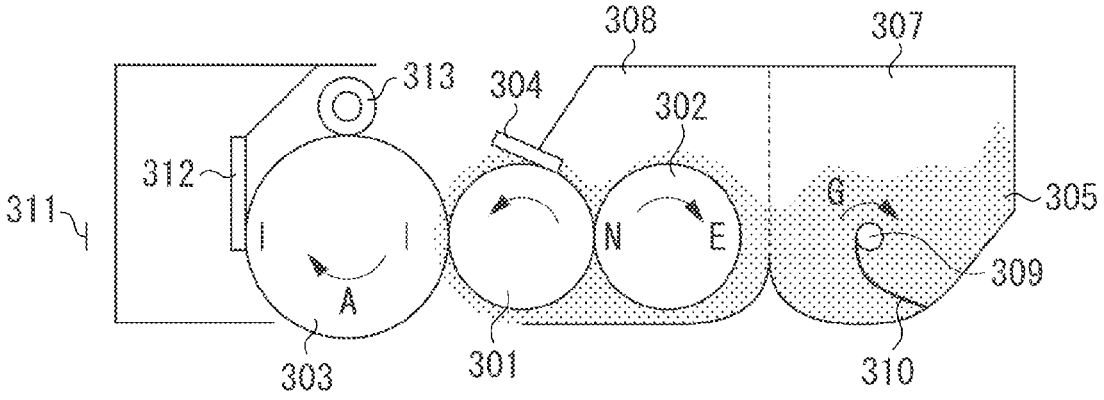
FIG. 2 is a schematic diagram illustrating a configuration of a developing device and a process cartridge according to the exemplary embodiment of the present invention.

FIG. 2 is a schematic cross-sectional view (main cross section) of the process cartridge according to the present exemplary embodiment, seen in a longitudinal direction (the direction of the rotational axis) of the photosensitive drum 303.

The process cartridge is configured to integrate the cleaning device 311 including the photosensitive drum 303 with the developing device 306 including the developing roller 301.

The cleaning device 311 includes a cleaning frame member serving as a frame member which supports various elements in the cleaning device 311. The photosensitive drum 303 is rotatably attached to the cleaning frame member via not-illustrated bearings. Driving force from a not-illustrated drive motor serving as a drive unit (drive source) is transmitted to the photosensitive drum 303, whereby the photosensitive drum 303 is driven to rotate in the direction of the arrow A (clockwise) illustrated in FIG. 2 according to an image forming operation. The photosensitive drum 303 plays a central role in the image forming process. In the present exemplary embodiment, the photosensitive drum 303 is an organic photosensitive drum including an aluminum cylinder, an outer peripheral surface of which is coated with functional films including an under coat layer, a carrier generation layer, and a carrier transport layer in order.

The cleaning device 311 further includes the cleaning member 312 and the charging roller 313, which are arranged in contact with the peripheral surface of the photosensitive drum 303. Transfer residual toner removed from the surface of the photosensitive drum 303 by the cleaning member 312 falls into and is stored in the cleaning frame member.

The charging roller 313 serving as a charging unit includes a roller portion made of conductive rubber. The roller portion is pressed into contact with the photosensitive drum 303, whereby the charging roller 313 is driven to rotate.

A predetermined direct-current voltage with respect to the photosensitive drum 303 is applied to a core of the charging roller 313. This forms a uniform dark portion potential (Vd) on the surface of the photosensitive drum 303. The photosensitive drum 303 is exposed to a spot pattern of laser beam emitted from the exposure device 212 according to image data. Exposed portions lose surface charges and drop in potential due to carriers from the carrier generation layer. As a result, an electrostatic latent image is formed on the photosensitive drum 303 with the exposed portions at a predetermined light portion potential (Vl) and the unexposed portions at the predetermined dark portion potential (Vd).

The developing device 306 includes the developing roller 301 and a development chamber 308. The developing roller 301 serves as a developer bearing member for bearing a developer (toner). The development chamber 308 includes a toner supply roller 302 serving as a developer supply member that supplies the toner to the developing roller 301. The developing device 306 further includes a toner storage chamber 307 which is a developer storage chamber storing the toner. The toner storage chamber 307 is arranged behind the development chamber 308 and communicates with the development chamber 308 through a development opening.

The toner storage chamber includes an agitation and conveyance member 310. The agitation and conveyance member 310 is intended to agitate the toner stored in the toner storage chamber 307 and convey the toner to the toner supply roller 302 in the direction of the arrow G in FIG. 2.

The toner supply roller 302 is arranged to form a predetermined contact portion (nip portion) N on the peripheral surface of the developing roller 301 in an opposed portion. The toner supply roller 302 rotates in the direction of the arrow E (clockwise) illustrated in FIG. 2, i.e., in a direction opposite to the rotation direction of the developing roller 301. The toner supply roller 302 is an elastic sponge roller including a foam layer formed on the outer periphery of a conductive core. In the contact portion N, the surfaces of the toner supply roller 302 and the developing roller 301 move in the same direction with a circumferential speed difference therebetween. By such an operation, the tonner supply roller 302 supplies the toner to the developing roller 301. A potential difference of the developing roller 301 with respect to the toner supply roller 302 can be adjusted to adjust the amount of toner supplied to the developing roller 301. In the present exemplary embodiment, the rotational circumferential speed ratio is set so that the toner supply roller 302 has a surface linear speed 150% with respect to that of the developing roller 301.

A developing blade 304 is arranged above the developing roller 301 and put in contact with the developing roller 301 in a counter direction. The developing blade 304 regulates the coating amount of the toner supplied by the toner supply roller 302 and gives charges to the toner.

The developing roller 301 and the photosensitive drum 303 rotate so that, in an opposed portion (contact portion), their surfaces move in the same direction (in the present exemplary embodiment, top to bottom).

The present exemplary embodiment includes a mechanism that separates the developing roller 301 and the photosensitive drum 303 from each other in a normal state (when not forming an image), and brings the developing roller 301 and the photosensitive drum 303 into contact with each other only during image formation.

In the present exemplary embodiment, non-magnetic negative polarity toner that is a mono-component developer is used as the developer. The toner is negatively charged by friction charging with respect to a predetermined direct-current bias applied to the developing roller 301. In a developing unit where the toner comes into contact with the photosensitive drum 303, the toner transfers only to the portions of the light portion potential to visualize the electrostatic latent image.

The developing roller 301 used in the present exemplary embodiment will be described.

The developing roller 301 according to the present exemplary embodiment includes a conductive agent-containing semiconductive elastic rubber layer arranged around a conductive supporting member. The conductive supporting member is a core electrode having an outer diameter of $\phi 6$ mm. A semiconductive silicone rubber layer containing a conductive agent is arranged around the core electrode.

The surface of the silicone rubber layer is coated with approximately 20 μm of acrylic urethane rubber layer. The entire developing roller 301 has an outer diameter of $\phi 12$ mm. The developing roller 301 has a resistance of $1\times10^6\Omega$. In the present exemplary embodiment, a developing bias power supply unit 110 serving as a first voltage application mechanism applies a voltage Vdr (=−300 V) to the developing roller 301.

A method for measuring the resistance of the developing roller 301 will be described.

The developing roller 301 is brought into contact with a 30-mm-diameter aluminum sleeve with a contact load of 9.8 N. The aluminum sleeve is rotated so that the developing roller 301 is driven to rotate at 60 rpm by the aluminum sleeve.

Next, a direct-current voltage of −50 V is applied to the developing roller 301. A resistor of 10 kΩ is connected to the ground side of the developing roller 301. The voltage across the resistor is measured to calculate the current, from which the resistance of the developing roller 301 is calculated.

If the developing roller 301 has a volume resistance of higher than $1\times10^9\Omega$, the voltage value of the developing bias at the surface of the developing roller 301 becomes low. This reduces the direct-current field in the developing area and causes lowering the developing efficiency, sometimes causing a drop in image density. To prevent such a drop in image density, the resistance of the developing roller 301 can be set to $10^9\Omega$ or lower.

As for the surface shape of the developing roller 301, the surface roughness of the developing roller 301 can be controlled to ensure compatibility between high image quality and high durability. For example, if the surface roughness of the developing roller 301 is set to 3.0 μm or less in Ra according to "Japanese Industrial Standards (JIS) B 0601," the conveyance amount of the developer is stabilized. If the surface roughness Ra of the developing roller 301 exceeds 3.0 μm, the conveyance amount of the developer on the developing roller 301 increases. In such a case, the friction with the developing blade 304 can fail to give sufficient charges to the developer, causing image fogging in blank portions.

Next, the toner supply roller 302 used in the present exemplary embodiment will be described.

The toner supply roller 302 according to the present exemplary embodiment includes a conductive supporting member and a foam layer supported by the conductive supporting member. Specifically, the toner supply roller 302 includes a core electrode having an outer diameter of ϕ5 mm, serving as the conductive supporting member, and a surrounding foamed urethane layer serving as the foam layer. The foam layer is made of an open-cell foam including interconnecting foams. The toner supply roller 302 rotates in the direction E in FIG. 2. In the present exemplary embodiment, the entire toner supply roller 302 has an outer diameter of ϕ12 mm.

Since the urethane of the surface layer is an open-cell foam, a large amount of toner can get into the toner supply roller 302. In the present exemplary embodiment, the toner supply roller 302 has a resistance of $1\times10^{9}\Omega$.

A method for measuring the resistance of the toner supply roller 302 will be described.

The toner supply roller 302 is brought into contact with a 30-mm-diameter aluminum sleeve by an intrusion amount of 1.5 mm. The intrusion amount refers to the amount of recess ΔE as much as which the toner supply roller 302 is recessed by the aluminum sleeve. The aluminum sleeve is rotated so that the toner supply roller 302 is driven to rotate at 30 rpm by the aluminum sleeve.

Next, a direct-current voltage of −50 V is applied to the toner supply roller 302. A resistor of 10 kΩ is connected to the ground side of the toner supply roller 302. The voltage across the resistor is measured to calculate the current, from which the resistance of the toner supply roller 302 is calculated.

In the present exemplary embodiment, the developing roller 301 and the tonner supply roller 302 both have an outer diameter of 12 mm. The intrusion amount of the toner supply roller 302 to the developing roller 301 is set to 1.0 mm.

To supply the toner lying between the developing roller 301 and the toner supply roller 302 to the developing roller 301 side, a toner supply roller bias power supply unit 112 serving as a second voltage application mechanism applies a voltage Vrs (=−500 V) to the toner supply roller 302 during normal printing.

To satisfy image density and sufficiently charge the toner by friction between the photosensitive drum 303 and the developing roller 301, the rotational circumferential speed ratio between the photosensitive drum 303 and the developing roller 301 can be 110% or higher. If the circumferential speed difference is set so that the rotational circumferential speed ratio exceeds 150%, increased mechanical stress on the contact portion may significantly degrade the developing roller 301 and/or the toner. From such a reason, the rotational circumferential speed ratio can be 110% to 150%. In the present exemplary embodiment, the rotational circumferential speed ratio is set to 120%.

In the present exemplary embodiment, the roller surfaces of the developing roller 301 and the toner supply roller 302 rotate in the same direction in the opposed portion. In other words, the developing roller 301 and the toner supply roller 302 rotate in opposite directions. A study conducted by the inventors revealed that when the developing roller 301 and the toner supply roller 302 rotate in opposite directions, the followability of a solid image improves as the printing speed decreases. The followability of a solid image refers to a characteristic that the toner is supplied from the toner supply roller 302 to the developing roller 301 as the toner borne on the developing roller 301 is consumed when printing a solid image (image with a high printing ratio). High followability refers to that a sufficient amount of toner can be supplied according to the amount of toner consumed. A relationship between the circumferential speed of the developing roller 301 and the followability of solid image density according to the present exemplary embodiment will be described by using a table seen below. A solid black image was printed on sheets. A SpectroDensitometer 500 manufactured by X-Rite, Incorporated, was used to measure each printed sheet for densities at the leading end and the trailing end. In the following table, A indicates that a difference in density between the leading and trailing ends is less than 0.2. B indicates that a difference in density between the leading and trailing ends resulting from such measurement is not less than 0.2 and less than 0.3. C indicates that a difference in density between the leading and trailing ends resulting from such measurement is 0.3 or greater. If the supply of the toner to the developing roller 301 is insufficient (solid followability is low), the image density decreases as image formation progresses. As a result, the image density at the trailing end of a sheet becomes lower than at the leading end of the sheet, causing a difference in density.

In the present exemplary embodiment, the toner has negative charge polarity. Consequently, the negatively higher the potential of the toner supply roller 302 is with respect to the developing roller 301, the more force the toner in the toner supply roller 302 receives from the electrical field toward the developing roller 301, and the toner is supplied to the developing roller 301. If the potential difference of the toner supply roller 302 with respect to the developing roller 301 is a small voltage difference in negative polarity and the solid image density is stable, the followability of the solid image can be said to be favorable. In the table seen below, the solid image density follows, even when the potential (potential difference) of the toner supply roller 302 with respect to the developing roller 301 negatively lower as the circumferential speed of the developing roller 301 lower. For example, in a coated paper mode, the developing roller 301 has a circumferential speed as low as 60 mm/sec. In such a case, even a potential difference V as small as −100 V can provide followability A. As the circumferential speed of the developing roller 301 decreases, the followability of the solid image density improves. The reason is that as the rotation speed of the toner supply roller 302 decreases with the decreasing speed of the developing roller 301, the amount of toner in the toner supply roller 302 increases, and the amount of toner conveyed to the developing roller 301 per rotation of the toner supply roller 302 increases.

| | Circumferential speed Sdr of developing roller | Potential difference V (V) | | | | |
|---|---|---|---|---|---|---|
| | (mm/sec) | −50 | −100 | −150 | −200 | −250 |
| Coated paper mode | 60 | B | A | A | A | A |
| Thick paper mode | 120 | C | B | A | A | A |
| Normal mode | 240 | C | C | B | A | A |
| Thin paper mode | 300 | C | C | C | B | A |

In the present exemplary embodiment, the main body of the image forming apparatus includes a central processing unit (CPU) 60 (control unit). The CPU 60 controls the power supplies included in the image forming apparatus (the toner supply roller bias power supply unit 112 and the developing bias power supply unit 110).

More specifically, the CPU 60 controls a toner supply roller bias and the developing bias based on the absolute value S of a speed difference between the photosensitive drum 303 and the developing roller 301. Possible absolute values S are preset in a storage unit. In other words, the CPU 60 functions as a unit that selects and switches a difference Vdif (=Vrs−Vdr) between the voltage Vrs applied to the toner supply roller 302 and the voltage Vdr applied to the developing roller 301.

In the present exemplary embodiment, the image forming apparatus has a plurality of printing speed modes to handle various printing media (recording materials).

Figure 3:
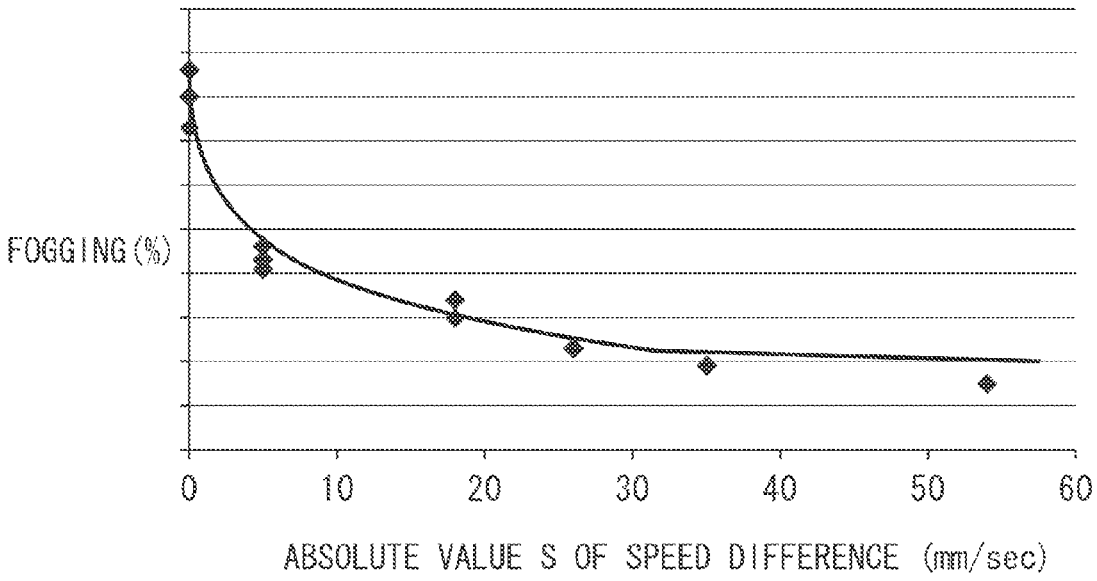
FIG. 3 is a chart illustrating a relationship between an absolute value S of a speed difference and fogging according to the exemplary embodiment of the present invention.

Suppose that the image forming apparatus produces output at a plurality of printing speeds while maintaining the rotational circumferential speed ratio between the photosensitive drum 303 and the developing roller 301 at 120%. In such a case, as shown in the following table, the absolute value S of the speed difference between the photosensitive drum 303 and the developing roller 301 decreases with the decreasing printing speed. According to a study conducted by the inventors, as illustrated in FIG. 3, there is the problem that fogging increases as the absolute value S of the speed difference decreases. The reason seems to be that the smaller the absolute value S of the speed difference between the photosensitive drum 303 and the developing roller 301, the longer it takes for the toner on the developing roller 301 to pass through the developing nip and the more the toner is developed in non-image portions.

| | Circumferential speed Sopc of photosensitive member (mm/sec) | Circumferential speed Sdr of developing roller (mm/sec) | Rotational circumferential speed ratio (%) | Absolute value S of speed difference (mm/sec) | Toner supply roller bias Vrs (V) | Developing bias Vdr (V) | Potential difference Vdif (v) |
|---|---|---|---|---|---|---|---|
| Coated paper mode | 50 | 60 | 120 | 10 | −400 | −300 | −100 |
| Thick paper mode | 100 | 120 | 120 | 20 | −450 | −300 | −150 |
| Normal mode | 200 | 240 | 120 | 40 | −500 | −300 | −200 |
| Thin paper mode | 250 | 300 | 120 | 50 | −550 | −300 | −250 |

In the present exemplary embodiment, the CPU 60 therefore controls the potential difference Vdif so that Vdif (=Vrs−Vdr) shifts toward the polarity opposite to the normal charge polarity of the toner as the absolute value S of the speed difference between the photosensitive drum 303 and the developing roller 301 decreases.

Figure 4:
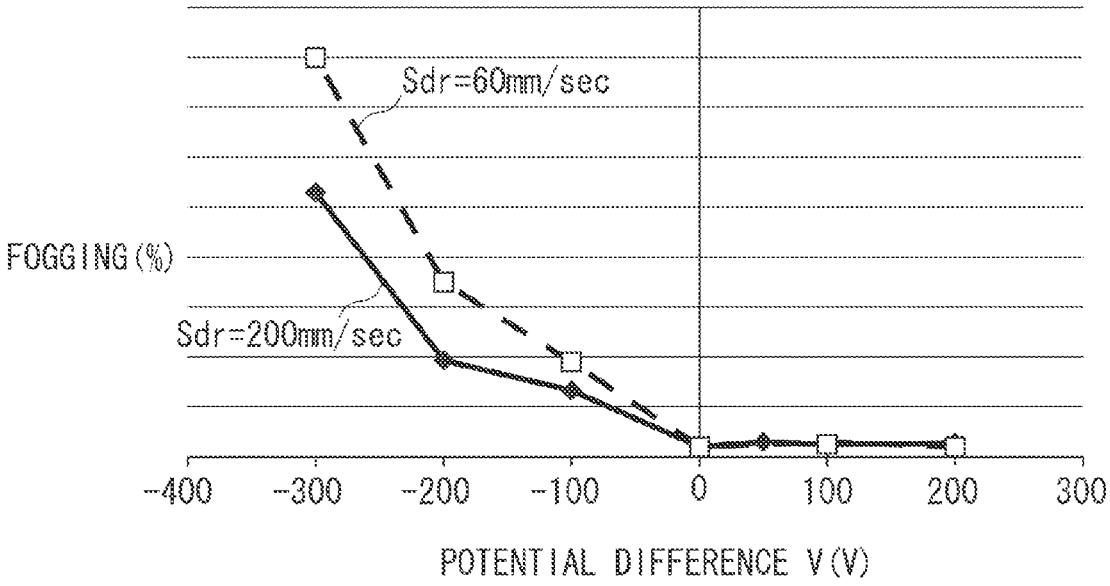
FIG. 4 is a chart illustrating a relationship between a potential difference V and fogging according to the exemplary embodiment of the present invention.
Figure 5:
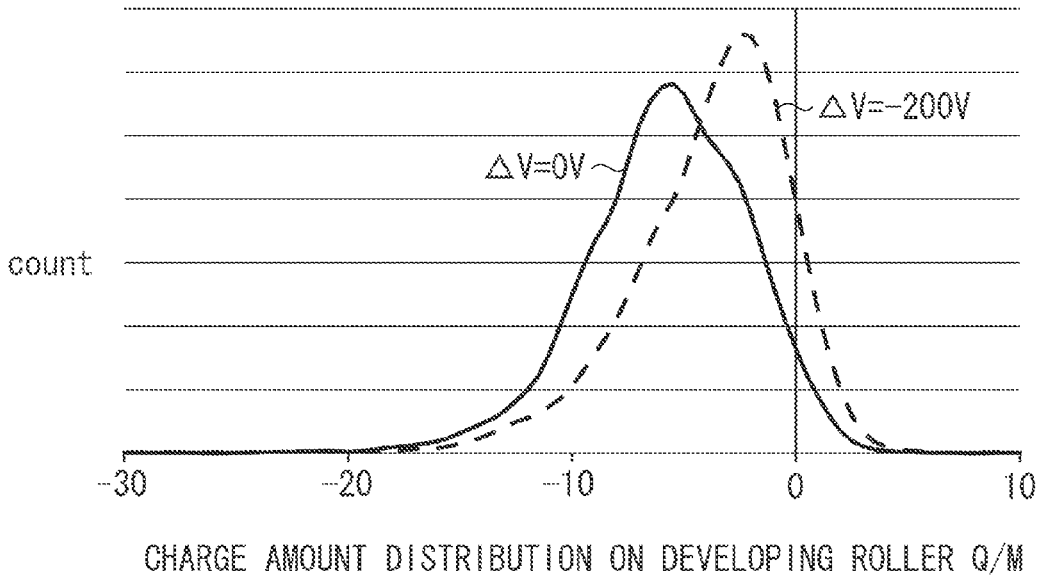
FIG. 5 is a chart illustrating a relationship between the potential difference V and a charge amount distribution on a developing roller according to the exemplary embodiment of the present invention.

A study conducted by the inventors provided a new finding about the configuration where a developing roller and a toner supply roller rotate in opposite directions like the present exemplary embodiment. As illustrated in FIG. 4, it was found that fogging decreases as the voltage Vrs applied to the toner supply roller 302 shifts toward the polarity opposite to the normal charge polarity of the toner with respect to the voltage Vdr applied to the developing roller 301. The reason is as follows: Shifting the voltage Vrs applied to the toner supply roller 302 toward the polarity opposite to the normal charge polarity of the toner reduces the amount of toner between the surface of the toner supply roller 302 and the surface of the developing roller 301. Sufficient charges can thus be given to the toner between the toner supply roller 302 and the developing roller 301. Consequently, as illustrated in FIG. 5, the charge amount of the toner on the developing roller 301 increases, and fogging in blank portions reduces.

If voltage Vrs applied to the toner supply roller 302 is reduced with the same polarity as the charge polarity of the toner, the toner supplying performance would typically decrease to lower the followability of a solid image. However, in the configuration where the developing roller 301 and the toner supply roller 302 rotate in opposite directions like the present exemplary embodiment, the toner supplying performance of the toner supply roller 302 increases as the printing speed decreases (as the absolute value S of the circumferential speed difference between the photosensitive drum 303 and the developing roller 301 decreases). This can ensure the followability of a solid image.

According to the exemplary embodiment of the present invention, the CPU 60 controls Vdr and Vrs so that Vdif shifts toward the polarity opposite to the normal charge polarity of the toner as the absolute value S of the speed difference decreases.

Specific controls will be described below. For example, if Vdif<0 is satisfied (Vdif has a value of the same polarity as the normal charge polarity of the toner (negative polarity)), the CPU 60 controls Vdr and Vrs so that Vdif decreases in absolute value as the absolute value S of the speed difference decreases. If Vdif≥0 (Vdif has a value of the polarity opposite to the normal charge polarity of the toner), the CPU 60 controls Vdr and Vrs so that Vdif increases in absolute value as the absolute value S of the speed difference decreases. In view of stabilizing density and suppressing fogging as well, the former is desirable. While the present exemplary embodiment uses the negative polarity toner, positive polarity toner may be used, in which case the foregoing inequality signs are reversed.

Figure 6:
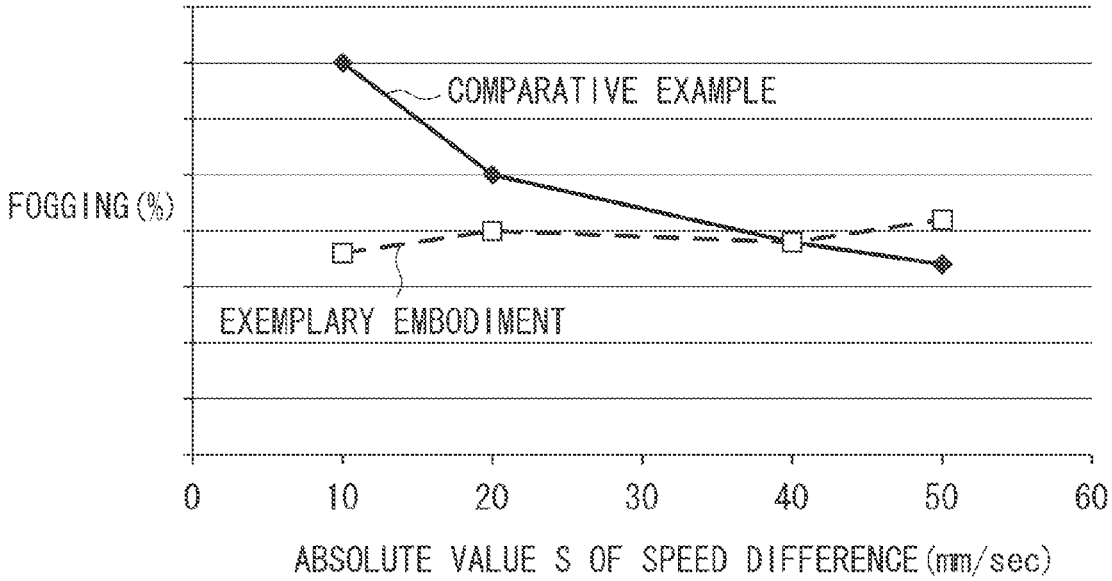
FIG. 6 is a chart illustrating a relationship between the absolute value S of the speed difference and fogging in each printing mode.

FIG. 6 is a chart illustrating a relationship between the absolute value S of the speed difference and fogging in each printing mode according to the present exemplary embodiment. A comparative example shows the relationship between the absolute value S of the speed difference and fogging when the potential difference Vdif is fixed so that Vdif=−200 V regardless of the absolute value S of the speed difference. In the comparative example, the fogging increases as the absolute value S of the speed difference decreases. The control of the present exemplary embodiment can be performed to suppress the fogging to near constant values regardless of the printing mode.

As described above, a high quality image can be formed by suppressing fogging without changing the circumferential speed ratio between the photosensitive drum 303 and the developing roller 301 regardless of the absolute value S of the speed difference between the photosensitive drum 303 and the developing roller 301.

The settings of the foregoing control method are determined by the degree of fogging and the followability of a solid image. Depending on an image forming apparatus, a developing device, and a toner to be used, the settings are not limited to the foregoing.

The settings of the foregoing control method have dealt with the case where the developing bias Vdr is constant. However, the developing bias Vdr may be changed for control without affecting the image density and other factors of the output image. The following table shows a control example in such a case.

| | Circumferential speed Sopc of photosensitive member (mm/sec) | Circumferential speed Sdr of developing roller (mm/sec) | Rotational circumferential speed ratio (%) | Absolute value S of speed difference (mm/sec) | Toner supply roller bias Vrs (V) | Developing bias Vdr (V) | Potential difference Vdif (v) |
|---|---|---|---|---|---|---|---|
| Coated paper mode | 50 | 60 | 120 | 10 | −300 | −200 | −100 |
| Thick paper mode | 100 | 120 | 120 | 20 | −400 | −250 | −150 |
| Normal mode | 200 | 240 | 120 | 40 | −500 | −300 | −200 |
| Thin paper mode | 250 | 300 | 120 | 50 | −600 | −350 | −250 |

As has been described above, according to the present exemplary embodiment, the CPU 60 controls Vdr and Vrs so that Vdif shifts toward the polarity opposite to the normal charge polarity of the toner as the absolute value S of the speed difference decreases. As a result, high quality images can be formed over a long period of time by suppressing fogging without progressing deterioration of the toner and the developing roller 301 regardless of the user's usage and the use environment.

The foregoing exemplary embodiment has been described by using the printer as an example of the image forming apparatus. However, an exemplary embodiment of the present invention is not limited thereto. For example, an exemplary embodiment of the present invention may be applied to other image forming apparatuses such as a copying machine and a facsimile apparatus, and multifunction peripherals and other image forming apparatuses combining the functions of such image forming apparatuses. An exemplary embodiment of the present invention may also be applied to an image forming apparatus that uses a recording material bearing member and successively transfers color toner images to a recording material borne on the recording material bearing member in a superposed manner.

According to the configuration described in the exemplary embodiments of the present invention, the image forming apparatus using the developing device in which the developer bearing member and the toner supply member rotate in opposite directions can stabilize the image density and suppress fogging while changing the image forming speed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-237795 filed Oct. 29, 2012, which is hereby incorporated by reference herein in its entirety.

What is claimed is:

1. An image forming apparatus comprising:

an image bearing member configured to rotate while bearing an electrostatic latent image;

a developer bearing member configured to rotate at a constant circumferential speed ratio with respect to the image bearing member while bearing a developer and to develop the electrostatic latent image;

a developer supply member, which includes a foam layer at a surface and is arranged in contact with the developer bearing member, configured to rotate in a direction opposite to a rotation direction of the developer bearing member at a constant circumferential speed ratio with respect to the developer bearing member and to supply the developer to the developer bearing member;

a first voltage application mechanism configured to apply a voltage Vdr to the developer bearing member;

a second voltage application mechanism configured to apply a voltage Vrs to the developer supply member; and a control unit configured to control the first and second voltage application mechanisms, wherein the control unit is configured to shift a difference Vdif (=Vrs−Vdr) between Vrs and Vdr toward polarity opposite to normal charge polarity of the developer as S decreases, where S is an absolute value of a speed difference between a circumferential speed of the image bearing member and a circumferential speed of the developer bearing member.

2. The image forming apparatus according to claim 1, wherein Vdif has a value of the same polarity as the normal charge polarity of the developer.

3. The image forming apparatus according to claim 1, wherein the image forming apparatus is configured to be capable of selecting a printing speed to print an image on a recording material, and wherein S decreases as the printing speed decreases.

4. The image forming apparatus according to claim 3, wherein the circumferential speed of the developer bearing member is higher than that of the image bearing member regardless of the printing speed.

5. The image forming apparatus according to claim 3, a ratio between the circumferential speed of the image bearing member and that of the developer bearing member is constant regardless of the printing speed.

6. The image forming apparatus according to claim 1, wherein a circumferential speed of the developer supply member decreases as the circumferential speed of the developer bearing member decreases.

7. The image forming apparatus according to claim 1, wherein a circumferential speed of the developer supply member is higher than that of the developer bearing member.

8. The image forming apparatus according to claim 1, wherein the control unit is configured to, when shifting Vdif, change the voltage Vrs applied to the developer supply member while keeping constant the voltage Vdr applied to the developer bearing member.

9. An image forming apparatus comprising:

an image bearing member configured to rotate while bearing an electrostatic latent image;

a developer bearing member configured to rotate at a constant circumferential speed ratio with respect to the image bearing member while bearing a developer and to develop the electrostatic latent image;

a developer supply member, which includes a foam layer at a surface and is arranged in contact with the developer bearing member, configured to rotate in a direction opposite to a rotation direction of the developer bearing member at a constant circumferential speed ratio with respect to the developer bearing member and to supply the developer to the developer bearing member;

a first voltage application mechanism configured to apply a voltage Vdr to the developer bearing member;

a second voltage application mechanism configured to apply a voltage Vrs to the developer supply member; and a control unit configured to control the first and second voltage application mechanisms, wherein the control unit is configured to cause a difference Vdif (=Vrs−Vdr) between Vrs and Vdr to have a value of the same polarity as normal charge polarity of the developer and to reduce Vdif in absolute value as S decreases, where S is an absolute value of a speed difference between a circumferential speed of the image bearing member and a circumferential speed of the developer bearing member.

10. The image forming apparatus according to claim 9, wherein the image forming apparatus is configured to be capable of selecting a printing speed to print an image on a recording material, and wherein S decreases as the printing speed decreases.

11. The image forming apparatus according to claim 10, wherein the circumferential speed of the developer bearing member is higher than that of the image bearing member regardless of the printing speed.

12. The image forming apparatus according to claim 10, wherein a ratio between the circumferential speed of the image bearing member and that of the developer bearing member is constant regardless of the printing speed.

13. The image forming apparatus according to claim 9, wherein a circumferential speed of the developer supply member decreases as the circumferential speed of the developer bearing member decreases.

14. The image forming apparatus according to claim 9, wherein the circumferential speed of developer supply member is higher than that of the developer bearing member.

15. The image forming apparatus according to claim 9, wherein the control unit is configured to, when changing Vdif, change the voltage Vrs applied to the developer supply member while keeping constant the voltage Vdr applied to the developer bearing member.

16. An image forming apparatus comprising:

an image bearing member configured to rotate while bearing an electrostatic latent image;

a developer bearing member configured to rotate at a constant circumferential speed ratio with reference to the image bearing member while bearing a developer and to develop the electrostatic latent image;

a developer supply member, which includes a foam layer at a surface and is arranged in contact with the developer bearing member, configured to rotate in a direction opposite to a rotation direction of the developer bearing member at a constant circumferential speed ratio with respect to the developer bearing member;

a first voltage application mechanism configured to apply a voltage Vdr to the developer bearing member;

a second voltage application mechanism configured to apply a voltage Vrs to the developer supply member; and a control unit configured to control the first and second voltage application mechanisms, wherein the control unit is configured to cause a difference Vdif (=Vrs−Vdr) between Vrs and Vdr to have a value of polarity reverse to normal charge polarity of the developer and to increase Vdif in absolute value as S decreases, where S is an absolute value of a speed difference between a circumferential speed of the image bearing member and a circumferential speed of the developer bearing member.

17. The image forming apparatus according to claim 16, wherein the image forming apparatus is configured to be capable of selecting a printing speed to print an image on a recording material, and wherein S decreases as the printing speed decreases.

18. The image forming apparatus according to claim 17, wherein the circumferential speed of the developer bearing member is higher than that of the image bearing member regardless of the printing speed.

19. The image forming apparatus according to claim 17, wherein a ratio between the circumferential speed of the image bearing member and that of the developer bearing member is constant regardless of the printing speed.

* * * * *